US010486282B2

(12) United States Patent
Liu et al.

(10) Patent No.: US 10,486,282 B2
(45) Date of Patent: Nov. 26, 2019

(54) WHEEL FLANGE BURR BRUSHING DEVICE

(71) Applicant: CITIC Dicastal CO., LTD, Qinhuangdao (CN)

(72) Inventors: Huiying Liu, Qinhuangdao (CN); Yacong Zhang, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 92 days.

(21) Appl. No.: 15/801,914

(22) Filed: Nov. 2, 2017

(65) Prior Publication Data

US 2019/0022817 A1 Jan. 24, 2019

(30) Foreign Application Priority Data

Jul. 21, 2017 (CN) ..... 2017 1 05982927

(51) Int. Cl.
*B24B 9/04* (2006.01)
*B24B 29/00* (2006.01)
*B24B 5/44* (2006.01)

(52) U.S. Cl.
CPC ..... *B24B 29/005* (2013.01); *B24B 5/44* (2013.01); *B24B 9/04* (2013.01); *B24B 29/00* (2013.01)

(58) Field of Classification Search
CPC .... B24B 5/44; B24B 9/02; B24B 9/04; B24B 19/00; B24B 21/02; B24B 21/12; B24B 21/16; B24B 19/28; B24B 29/00; B24B 29/005
USPC ..... 451/258
See application file for complete search history.

(56) References Cited

U.S. PATENT DOCUMENTS 3,258,804 A * 7/1966 Fowle ..... B24B 5/225 15/104.011
4,216,560 A * 8/1980 Schmidt ..... B24B 41/06 15/268
5,134,807 A * 8/1992 Keefe ..... B24B 7/16 451/259

(Continued)

FOREIGN PATENT DOCUMENTS

CN 103846765 A 6/2014
CN 205290569 U 6/2016

(Continued)

*Primary Examiner* — Eileen P Morgan
(74) *Attorney, Agent, or Firm* — Calfee, Halter & Griswold LLP

(57) ABSTRACT

Disclosed is a wheel flange burr brushing device, comprising clamping roller motors, a second clamping cylinder, second travel switches, a second feeding sliding plate, an upper rack, a gear, a lower rack, a feeding guide rail, belt pulleys, driving belts, rotating shaft supports, servo motors and the like. After feeding, a first clamping cylinder and a second clamping cylinder move synchronously first to clamp a wheel; next, the clamping roller motors are started to drive the wheel to rotate; then a lifting cylinder is started to drive a lifting platform to ascend, meanwhile, a feeding cylinder is started to drive a first feeding sliding plate and the second feeding sliding plate to reciprocate, and the servo motors are started to drive burr brushes to reverse cyclically; and the lifting cylinder stops moving when the burr brushes contact the flange face, the burr brushes begin brushing burrs.

3 Claims, 3 Drawing Sheets

(56) References Cited

U.S. PATENT DOCUMENTS

| | | | | | |
|---|---|---|---|---|---|
| 5,161,281 | A * | 11/1992 | Hanen | B08B 1/04 | 15/88.3 |
| 5,762,542 | A * | 6/1998 | Sandvold | B24B 9/002 | 451/188 |
| 2007/0037497 | A1 * | 2/2007 | Tanaka | B24B 5/44 | 451/312 |
| 2007/0042678 | A1 * | 2/2007 | Tanaka | B24B 5/44 | 451/5 |
| 2013/0102233 | A1 * | 4/2013 | Cheon | B24B 27/033 | 451/331 |

FOREIGN PATENT DOCUMENTS

| | | | | | |
|---|---|---|---|---|---|
| CN | 106363481 | A | | 2/2017 | |
| CN | 106826455 | A | | 6/2017 | |
| GB | 667407 | A | * | 2/1952 | B24B 5/44 |
| JP | 3044289 | B2 | * | 5/2000 | |
| JP | 3091417 | B2 | * | 9/2000 | |

* cited by examiner

WHEEL FLANGE BURR BRUSHING DEVICE

CROSS-REFERENCE TO RELATED APPLICATIONS

This application claims priority to Chinese Patent Application No. 201710598292.7 filed on Jul. 21, 2017, which is hereby incorporated by reference in its entirety.

TECHNICAL FIELD

The present application relates to the field of burr removal, specifically to a device for removing burrs at a wheel flange.

BACKGROUND ART

A flange weight reduction pit is often designed on the flange face of an aluminum alloy wheel in order to reduce the weight, flange drainage channels are designed on two sides of the flange weight reduction pit, the inner drainage channel communicates with the weight reduction pit and a central hole, and the outer drainage channel communicates with the weight reduction pit and the outer edge of the flange. The surface of the flange is machined and turned, and the flange weight reduction pit and the flange drainage channels are cast, so after machining, many burrs remain at the handover positions of casting and machining at the edges of the weight reduction pit and the drainage channels; these burrs need to be cleaned manually one by one, and there are a lot of irregular weight reduction pits and drainage channels, so the burrs are difficult to remove and easily missing to scrape, and the removal efficiency is low.

SUMMARY OF THE INVENTION

The aim of the present application is to provide a device for automatically removing burrs at a wheel flange.

In order to fulfill the above aim, the present application adopts the following technical solution: a wheel flange burr brushing device comprises a frame, a lifting cylinder, lifting guide rails, a lifting platform, a support, a feeding cylinder, first travel switches, a first feeding sliding plate, a first clamping cylinder, clamping guide rails, a first clamping sliding plate, burr brushes, clamping rollers, a second clamping sliding plate, clamping roller motors, a second clamping cylinder, second travel switches, a second feeding sliding plate, an upper rack, a gear, a lower rack, a feeding guide rail, belt pulleys, driving belts, rotating shaft supports and servo motors.

The first clamping cylinder is connected with the first clamping sliding plate, the second clamping cylinder is connected with the second clamping sliding plate, the first clamping sliding plate and the second clamping sliding plate are respectively mounted on the clamping guide rails. A wheel can be positioned and clamped when the first clamping cylinder and the second clamping cylinder move synchronously. The four clamping roller motors are symmetrically mounted on the clamping sliding plates, the output ends of the clamping roller motors are connected with the clamping rollers to control rotation of the clamping rollers, and the wheel can be driven to rotate by the rotation of the clamping rollers, so that rotation of the wheel in the clamped state is realized.

The four lifting guide rails are symmetrically mounted on the lateral surfaces of the frame, the lifting cylinder is located in the center of the bottom of the frame, and the output end of the lifting cylinder is connected with the lifting platform to control ascending and descending of the lifting platform.

The feeding guide rail and the support are mounted on the lifting platform. The first feeding sliding plate and the second feeding sliding plate are mounted on the feeding guide rail and connected with each other via a gear rack structure. The feeding cylinder is mounted on the support, and the output end of the feeding cylinder is connected with the first feeding sliding plate. When the feeding cylinder drives the first feeding sliding plate to move left and right, the second feeding sliding plate moves synchronously with the left feeding sliding plate under the engagement effect of the gear and the racks. The first travel switches and the second travel switches are symmetrically mounted on the feeding guide rail; when the sliding plates touch the first travel switches, the output end of the feeding cylinder extends; when the sliding plates touch the second travel switches, the output end of the feeding cylinder retracts; thus, synchronous reciprocating motion of the first feeding sliding plate and the second feeding sliding plate within the fixed distance is realized.

The rotating shaft supports are symmetrically and fixedly mounted on the first feeding sliding plate and the second feeding sliding plate, and the servo motors are mounted on the rotating shaft supports. The belt pulleys and the burr brushes are fixedly mounted on rotating shafts of the rotating shaft supports, the output ends of the servo motors are connected with the belt pulleys by the driving belts, and the servo motors can drive the burr brushes to rotate synchronously when driving the belt pulleys to rotate.

In an initial state, the output end of the feeding cylinder extends, the burr brush on the first feeding sliding plate rotates clockwise, and the burr brush on the second feeding sliding plate rotates counterclockwise, i.e., both of the burr brushes brush burrs from the outer side of a flange to a central hole; and when the sliding plates touch the second travel switches, a signal is fed back to the servo motors. The servo motors reverse, and the burr brush on the first feeding sliding plate rotates counterclockwise, and the burr brush on the second feeding sliding plate rotates clockwise, i.e., both of the burr brushes brush burrs from the central hole to the outer side of the flange. When the sliding plates touch the first travel switches, a signal is fed back to the servo motors. The servo motors reverse, and the initial state is restored, i.e., the burr brush on the first feeding sliding plate rotates clockwise, and the burr brush on the second feeding sliding plate rotates counterclockwise. Both of the burr brushes brush burrs from the outer side of the flange to the central hole, and the burr brushes reverse again till the sliding plates touch the second travel switches, and recycling like this. Burrs are removed from the radial direction of the wheel flange by cyclic reversal of the burr brushes, and burrs on all weight reduction pits and drainage channels in the flange face of the wheel can be removed under the cooperation of rotation of the wheel. In this process, burrs at the wheel flange are thoroughly cleaned in all directions due to radial cyclic reversal torque and circumferential rotating force.

The working process of the wheel flange burr brushing device is as follows: after feeding, the first clamping cylinder and the second clamping cylinder move synchronously first to clamp the wheel; next, the clamping roller motors are started to drive the wheel to rotate; then the lifting cylinder is started to drive the lifting platform to ascend, meanwhile, the feeding cylinder is started to drive the first feeding sliding plate and the second feeding sliding plate to reciprocate, and the servo motors are started to drive the burr brushes to reverse cyclically; and the lifting cylinder stops moving when the burr brushes contact the flange face, the burr brushes begin brushing burrs, the lifting cylinder retracts after the burrs are brushed, the lifting platform descends and is reset, the clamping rollers loosen the wheel, the roller bed conveys the wheel to next procedure and receives next wheel having burrs to be removed, and recycling like this.

The present application may remove burrs from the edges of drainage channels and weight reduction pits of a wheel flange, effectively improve the burr removing effect and improve the burr removing efficiency; and the device is efficient, practical and flexible in operation, and may clean burrs at the flange in all directions and meet automatic continuous production.

Figure 1:
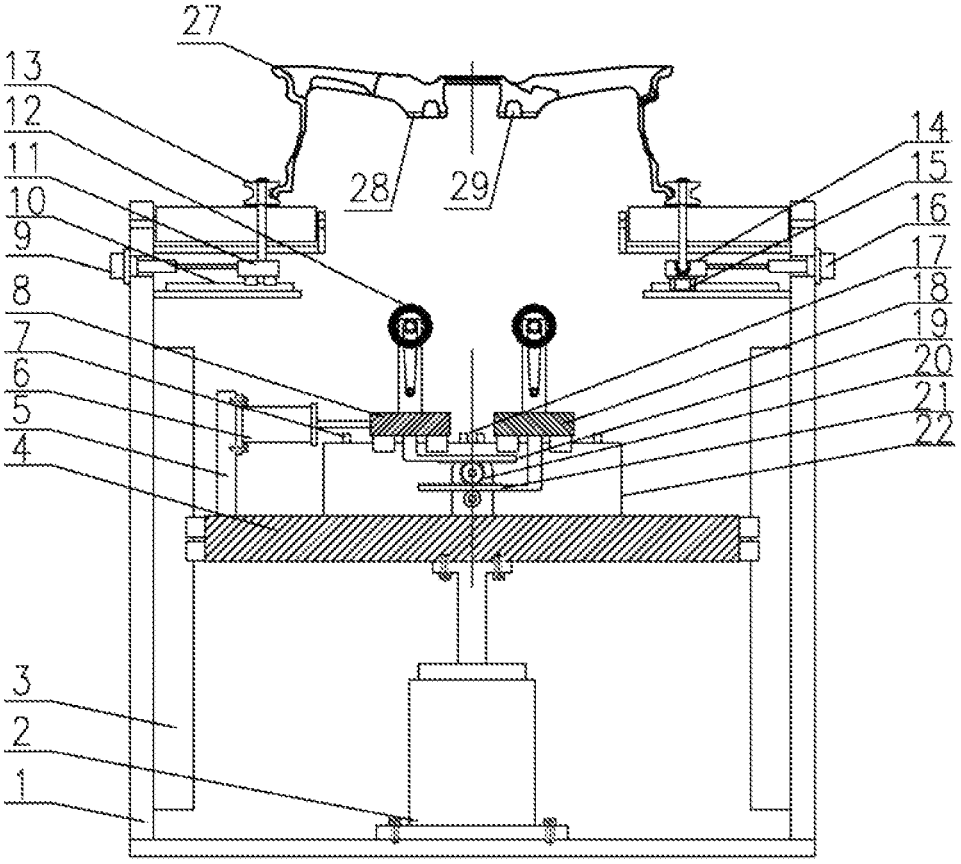
FIG. 1 is a front view of a wheel flange burr brushing device of the present application.
Figure 2:
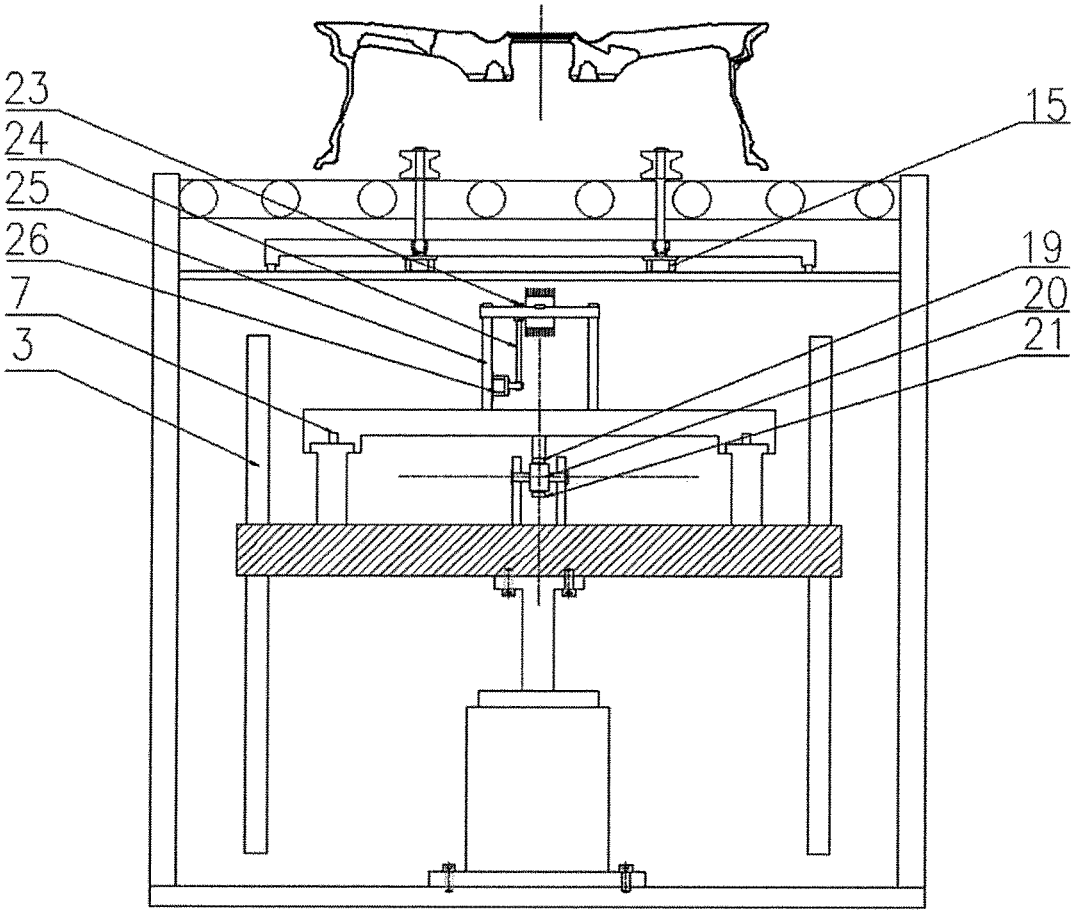
FIG. 2 is a left view of the wheel flange burr brushing device of the present application.
Figure 3:
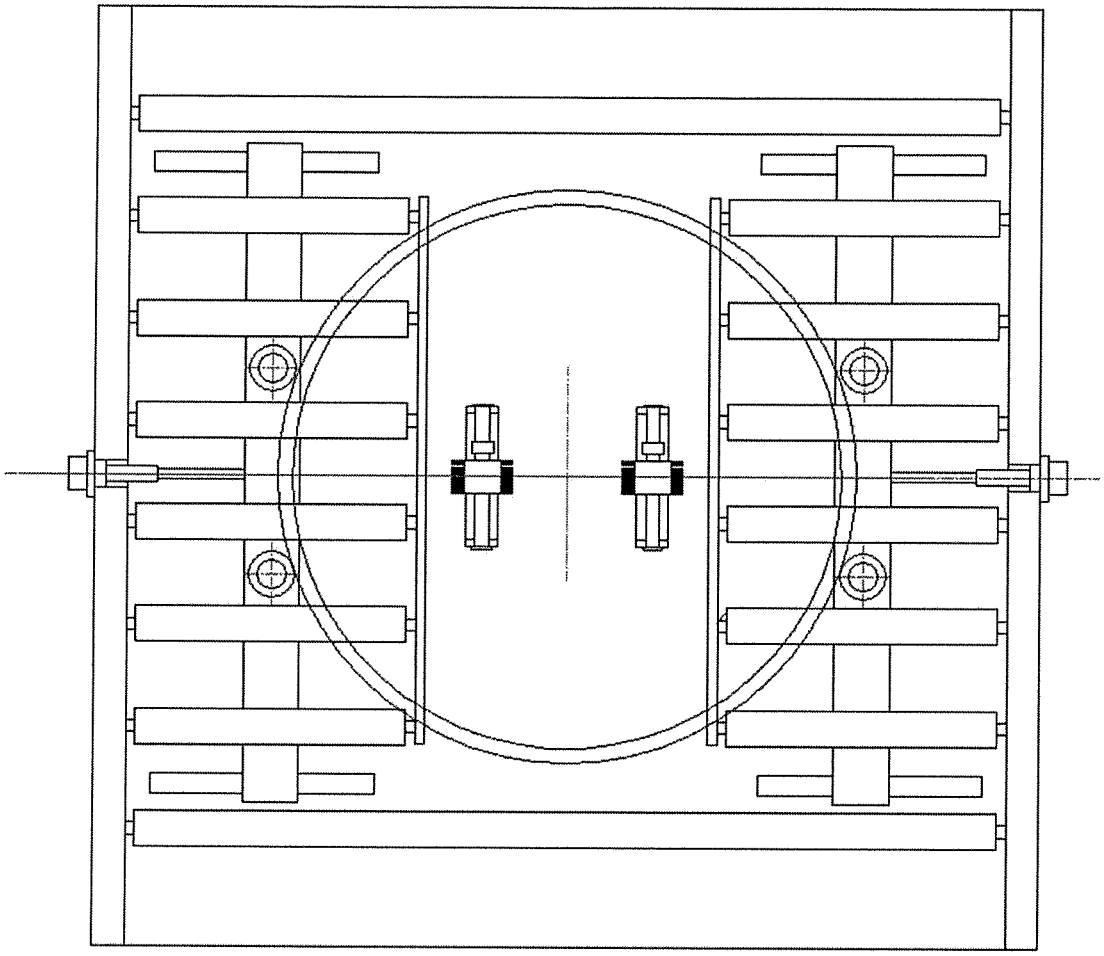
FIG. 3 is a top view of the wheel flange burr brushing device of the present application.

In which: 1-frame, 2-lifting cylinder, 3-lifting guide rail, 4-lifting platform, 5-support, 6-feeding cylinder, 7-first travel switch, 8-first feeding sliding plate, 9-first clamping cylinder, 10-clamping guide rail, 11-first clamping sliding plate, 12-burr brushes, 13-clamping roller, 14-second clamping sliding plate, 15-clamping roller motor, 16-second clamping cylinder, 17-second travel switch, 18-second feeding sliding plate, 19-upper rack, 20-gear, 21-lower rack, 22-feeding guide rail, 23-belt pulley, 24-driving belt, 25-rotating shaft support, 26-servo motor; 27-wheel flange; 28-drainage channels; 29-weight reduction pits.

DETAILED DESCRIPTION OF THE INVENTION

Specific details and working conditions of a device provided by the present application will be given below in combination with the accompanying drawings.

A wheel flange burr brushing device comprises a frame 1, a lifting cylinder 2, lifting guide rails 3, a lifting platform 4, a support 5, a feeding cylinder 6, first travel switches 7, a first feeding sliding plate 8, a first clamping cylinder 9, clamping guide rails 10, a first clamping sliding plate 11, burr brushes 12, clamping rollers 13, a second clamping sliding plate 14, clamping roller motors 15, a second clamping cylinder 16, second travel switches 17, a second feeding sliding plate 18, an upper rack 19, a gear 20, a lower rack 21, a feeding guide rail 22, belt pulleys 23, driving belts 24, rotating shaft supports 25 and servo motors 26.

The first clamping cylinder 9 is connected with the first clamping sliding plate 11, the second clamping cylinder 16 is connected with the second clamping sliding plate 14, the first clamping sliding plate 11 and the second clamping sliding plate 14 are respectively mounted on the clamping guide rails 10. A wheel can be positioned and clamped when the first clamping cylinder 9 and the second clamping cylinder 16 move synchronously. The four clamping roller motors 15 are symmetrically mounted on the first clamping sliding plate 11 and the second clamping sliding plate 14, the output ends of the clamping roller motors 15 are connected with the clamping rollers 13 to control rotation of the clamping rollers 13, and the wheel can be driven to rotate by the rotation of the clamping rollers 13, so that rotation of the wheel in the clamped state is realized.

The four lifting guide rails 3 are symmetrically mounted on the lateral surfaces of the frame 1, the lifting cylinder 2 is located in the center of the bottom of the frame 1, and the output end of the lifting cylinder 2 is connected with the lifting platform 4 to control ascending and descending of the lifting platform 4.

The feeding guide rail 22 and the support 5 are mounted on the lifting platform 4. The first feeding sliding plate 8 and the second feeding sliding plate 18 are mounted on the feeding guide rail 22 and connected with each other via a gear rack structure. The feeding cylinder 6 is mounted on the support 5, and the output end of the feeding cylinder 6 is connected with the first feeding sliding plate 8. When the feeding cylinder 6 drives the first feeding sliding plate 8 to move left and right, the second feeding sliding plate 18 moves synchronously with the first feeding sliding plate 8 under the engagement effect of the gear and the racks. The first travel switches 7 and the second travel switches 17 are symmetrically mounted on the feeding guide rail 22; when the sliding plates touch the first travel switches 7, the output end of the feeding cylinder 6 extends; when the sliding plates touch the second travel switches 17, the output end of the feeding cylinder 6 retracts; thus, synchronous reciprocating motion of the first feeding sliding plate 8 and the second feeding sliding plate 18 within the fixed distance is realized.

The rotating shaft supports 25 are symmetrically and fixedly mounted on the first feeding sliding plate 8 and the second feeding sliding plate 18, the servo motors 26 are mounted on the rotating shaft supports 25. The belt pulleys 23 and the burr brushes 12 are fixedly mounted on rotating shafts of the rotating shaft supports 25, the output ends of the servo motors 26 are connected with the belt pulleys 23 by the driving belts 24, and the servo motors 26 can drive the burr brushes 12 to rotate synchronously when driving the belt pulleys 23 to rotate.

In an initial state, the output end of the feeding cylinder 6 extends, the burr brush 12 on the first feeding sliding plate 8 rotates clockwise, and the burr brush 12 on the second feeding sliding plate 18 rotates counterclockwise, i.e., both of the burr brushes 12 brush burrs from the outer side of a flange to a central hole; and when the first feeding sliding plate 8 and the second feeding sliding plate 18 touch the second travel switches 17, a signal is fed back to the servo motors 26. The servo motors 26 reverse, the burr brush 12 on the first feeding sliding plate 8 rotates counterclockwise, and the burr brush 12 on the second feeding sliding plate 18 rotates clockwise, i.e., both of the burr brushes 12 brush burrs from the central hole to the outer side of the flange. When the first feeding sliding plate 8 and the second feeding sliding plate 18 touch the first travel switches 7, a signal is fed back to the servo motors 26. The servo motors 26 reverse, and the initial state is restored, i.e., the burr brush 12 on the first feeding sliding plate 8 rotates clockwise, and the burr brush 12 on the second feeding sliding plate 18 rotates counterclockwise, both of the burr brushes 12 brush burrs from the outer side of the flange to the central hole, the burr brushes 12 reverse again till the first feeding sliding plate 8 and the second feeding sliding plate 18 touch the second travel switches 17, and recycling like this. Burrs are removed from the radial direction of the wheel flange 27 by cyclic reversal of the burr brushes 12, and burrs on all weight reduction pits 29 and drainage channels 28 in the flange face of the wheel can be removed under the cooperation of rotation of the wheel. In this process, burrs at the wheel flange 27 are thoroughly cleaned in all directions due to radial cyclic reversal torque and circumferential rotating force.

The working process of the wheel flange burr brushing device is as follows: after feeding, the first clamping cylinder 9 and the second clamping cylinder 16 move synchronously first to clamp the wheel; next, the clamping roller motors 15 are started to drive the wheel to rotate; then the lifting cylinder 2 is started to drive the lifting platform 4 to ascend, meanwhile, the feeding cylinder 6 is started to drive the first feeding sliding plate 8 and the second feeding sliding plate 18 to reciprocate, and the servo motors 26 are started to drive the burr brushes 12 to reverse cyclically; and the lifting cylinder 2 stops moving when the burr brushes 12 contact the flange face, the burr brushes 12 begin brushing burrs, the lifting cylinder 2 retracts after the burrs are brushed, the lifting platform 4 descends and is reset, the clamping rollers 13 loosen the wheel, the roller bed conveys the wheel to next procedure and receives next wheel having burrs to be removed, and recycling like this.

The present application may remove burrs from the edges of drainage channels 28 and weight reduction pits 29 of a wheel flange, effectively improve the burr removing effect and improve the burr removing efficiency; and the device is efficient, practical and flexible in operation, and may clean burrs at the flange in all directions and meet automatic continuous production.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A wheel flange burr brushing device, comprising a frame, a lifting cylinder, lifting guide rails, a lifting platform, a support, a feeding cylinder, at least two first travel switches, a first feeding sliding plate, a first clamping cylinder, clamping guide rails, a first clamping sliding plate, at least two burr brushes, at least four clamping rollers, a second clamping sliding plate, at least four clamping roller motors, a second clamping cylinder, at least two second travel switches, a second feeding sliding plate, an upper rack, a gear, a lower rack, a feeding guide rail, at least two belt pulleys, at least two driving belts, at least two rotating shaft supports and at least two servo motors, wherein the feeding guide rail and the support are mounted on the lifting platform, the first feeding sliding plate and the second feeding sliding plate are mounted on the feeding guide rail and connected with each other via a gear-rack structure, the feeding cylinder is mounted on the support, the output end of the feeding cylinder is connected with the first feeding sliding plate, and when the feeding cylinder drives the first feeding sliding plate to move left and right, the second feeding sliding plate moves synchronously with the first feeding sliding plate under the engagement effect of the gear and the racks; the first travel switches and the second travel switches are symmetrically mounted on the feeding guide rail; when the sliding plates touch the first travel switches, the output end of the feeding cylinder extends; when the sliding plates touch the second travel switches, the output end of the feeding cylinder retracts; thus, synchronous reciprocating motion of the first feeding sliding plate and the second feeding sliding plate within the fixed distance is realized;

a working process of the wheel flange burr brushing device is as follows: after feeding, the first clamping cylinder and the second clamping cylinder move synchronously first to clamp the wheel; next, the clamping roller motors are started to drive the wheel to rotate; then the lifting cylinder is started to drive the lifting platform to ascend, meanwhile, the feeding cylinder is started to drive the first feeding sliding plate and the second feeding sliding plate to reciprocate, and the servo motors are started to drive the burr brushes to reverse cyclically; and the lifting cylinder stops moving when the burr brushes contact the flange face, the burr brushes begin brushing burrs, the lifting cylinder retracts after the burrs are brushed, the lifting platform descends and is reset, the clamping rollers loosen the wheel, the roller bed conveys the wheel to next procedure and receives next wheel having burrs to be removed.

2. The wheel flange burr brushing device according to claim 1, wherein the rotating shaft supports are symmetrically and fixedly mounted on the first feeding sliding plate and the second feeding sliding plate, the servo motors are mounted on the rotating shaft supports, the belt pulleys and the burr brushes are fixedly mounted on rotating shafts of the rotating shaft supports, output ends of the servo motors are connected with the belt pulleys by the driving belts, and the servo motors are configured to drive the burr brushes to rotate synchronously when driving the belt pulleys to rotate.

3. The wheel flange burr brushing device according to claim 1, wherein in an initial state, output end of the feeding cylinder extends, the burr brush on the first feeding sliding plate rotates clockwise, and the burr brush on the second feeding sliding plate rotates counterclockwise, wherein both of the burr brushes brush burrs from the outer side of a flange to a central hole; and when the sliding plates touch the second travel switches, a signal is fed back to the servo motors, the servo motors reverse, the burr brush on the first feeding sliding plate rotates counterclockwise, and the burr brush on the second feeding sliding plate rotates clockwise, wherein both of the burr brushes brush burrs from the central hole to the outer side of the flange; when the sliding plates touch the first travel switches, a signal is fed back to the servo motors, the servo motors reverse, the initial state is restored, wherein the burr brush on the first feeding sliding plate rotates clockwise, and the burr brush on the second feeding sliding plate rotates counterclockwise, both of the burr brushes brush burrs from the outer side of the flange to the central hole, the burr brushes reverse again till the sliding plates touch the second travel switches.

* * * * *